US011246408B2

(12) United States Patent
Jiang et al.

(10) Patent No.: US 11,246,408 B2
(45) Date of Patent: Feb. 15, 2022

(54) FOLDABLE RACK

(71) Applicant: ZHONGSHAN GUANNIAN METAL PRODUCTS CO., LTD., Zhongshan (CN)

(72) Inventors: Anqi Jiang, Foshan (CN); Yiguang Jiang, Zhongshan (CN)

(73) Assignee: ZHONGSHAN GUANNIAN METAL PRODUCTS CO., LTD., Zhongshan (CN)

( * ) Notice: Subject to any disclaimer, the term of this patent is extended or adjusted under 35 U.S.C. 154(b) by 0 days.

(21) Appl. No.: 17/315,282

(22) Filed: May 8, 2021

(65) Prior Publication Data

US 2021/0345771 A1 Nov. 11, 2021

(30) Foreign Application Priority Data

May 9, 2020 (CN) ..... 202020752916.3

(51) Int. Cl.
*A47B 43/00* (2006.01)
*A47F 5/10* (2006.01)
*A47B 31/04* (2006.01)

(52) U.S. Cl.
CPC ..... *A47B 43/00* (2013.01); *A47B 31/04* (2013.01); *A47F 5/10* (2013.01)

(58) Field of Classification Search
CPC ... A47F 5/10; A47F 5/13; A47F 5/137; A47B 43/00; A47B 31/04
See application file for complete search history.

(56) References Cited

U.S. PATENT DOCUMENTS 997,079 A * 7/1911 Moraff ..... A47B 43/00 108/176
1,167,550 A * 1/1916 Forsyth ..... A47F 5/13 108/163
6,851,564 B2 * 2/2005 Ng ..... A47B 43/00 211/149
RE41,763 E * 9/2010 Ng ..... A47B 43/00 211/149
8,256,629 B2 * 9/2012 Zhu ..... A47B 43/00 211/149
8,256,630 B2 * 9/2012 Zhu ..... A47F 5/10 211/149
8,468,956 B2 * 6/2013 Parizek ..... A47B 3/12 108/64
8,672,147 B2 * 3/2014 Lam ..... A47F 7/18 211/149
9,226,574 B1 * 1/2016 Chen ..... A47B 96/021
(Continued)

*Primary Examiner* — Kimberley S Wright

(57) ABSTRACT

The present disclosure provides a foldable rack, each of foldable plates of the foldable rack includes a first layer plate and a second layer plate, a first connecting piece is connected to a left end of the first layer plate, a second connecting piece is connected to a right end of the second layer plate, a supporting rod is connected with the first connecting piece and the second connecting piece through a pin shaft, a lock catch assembly includes a slider, a driving arm, an upper lock catch, and a lock hook piece, the slider is matched and sleeved on the supporting rod, a left end and a right end of the slider are respectively pivotally connected with one of slider supporting rods, the lock hook piece is separated from the supporting rod and is disposed on the first connecting piece or the second connecting piece.

8 Claims, 15 Drawing Sheets

(56) References Cited

U.S. PATENT DOCUMENTS

| | | | | |
|---|---|---|---|---|
| 9,474,368 | B2 * | 10/2016 | Frankel | A47F 5/10 |
| 9,913,533 | B1 * | 3/2018 | Ke | A47B 96/021 |
| 10,292,491 | B1 * | 5/2019 | Ke | A47F 5/137 |
| 10,604,170 | B1 * | 3/2020 | Davis | B62B 3/02 |
| 11,116,313 | B2 * | 9/2021 | Leung | A47B 43/00 |
| 2004/0226491 | A1 * | 11/2004 | Chen | A47B 3/002 108/124 |
| 2004/0238469 | A1 * | 12/2004 | Ng | A47B 43/00 211/149 |
| 2006/0226309 | A1 * | 10/2006 | Pao | A47F 5/10 248/122.1 |
| 2010/0326938 | A1 * | 12/2010 | Zhu | A47F 5/10 211/149 |
| 2011/0068072 | A1 * | 3/2011 | Zhu | A47B 43/00 211/149 |
| 2016/0066687 | A1 * | 3/2016 | Frankel | A47B 55/02 211/149 |
| 2020/0405050 | A1 * | 12/2020 | Liu | A47F 5/10 |

* cited by examiner

FOLDABLE RACK

TECHNICAL FIELD

The present disclosure relates to a field of racks, and in particularly to a foldable rack.

BACKGROUND

At present, in order to increase indoor position for placing items, many families purchase racks, each of the racks usually includes at least two layer plates horizontally disposed, and the items are placed on each of the layer plates. Now, many furniture including racks are sold on internet, weight of the racks is light, but volume is large, so that a foldable rack appear on market, a folded shape of the foldable rack is plate-shaped, which is beneficial to reduce space occupation during transportation. A structure of the foldable rack is as follows: the foldable rack includes a plurality of layers of foldable plates, supports disposed on two sides of the foldable plates, and a supporting rod disposed in parallel with the supports and connected with each layer of foldable plates; each of the foldable plates include a left layer plate and a right layer plate, sides of the left layer plate and the right layer plate distal from each other are rotatably connected with the supports on the sides, a first connecting piece and a second connecting piece are respectively disposed on sides of the left layer plate and the right layer plate close to each other, and the first connecting piece matches with the second connecting piece; sides of the first connecting piece and the second connecting piece close to the supporting rod are simultaneously rotatably connected to the supporting rod by a rotating pin, and sides of the first connecting piece and the second connecting piece distal from the supporting rod are rotatably connected by a pin shaft; the supporting rod is sleeved with a lock catch, a lock hook piece matched the lock catch is disposed on a top of the supporting rod, and reinforcing rods rotatably connected with the supports on the two sides are disposed on two sides of the lock catch; when the foldable plates are unfolded, the reinforcing rods are unfolded relative to the supporting rod so that the lock catch moves upwards relative to the supporting rod and is buckled with the lock hook piece at the top of the supporting rod; when the folding plates are folded, the lock catch is separated from the lock hook piece, the reinforcing rods are close to the supporting rod, and the lock buckle moves downwards relative to the top of the supporting rod; buckling of the lock buckle and the lock hook piece is configured to prevent the folding plates from folding up during use and further prevents the items from falling. Since the lock hook piece of the foldable rack on the market is disposed on the top of the supporting rod, the top of the supporting rod serves as not only a connecting part of the rotating pin but also an installation part of the lock hook piece, so that a connection relationship of a part of the top of the supporting rod is too complicated to easily lock the rotating pin, the supporting rod is a hollow rectangular tube having low strength, so that pulling force of the lock buckle easily causes the supporting rod to be bent, after the supporting rod is bent, buckling connection between the lock catch and the lock hook piece is loosened, which affects a function of preventing the foldable plates from being accidentally folded during use, that is, stability of the foldable rack in the prior art is poor.

SUMMARY

A purpose of the present disclosure is to overcome shortcomings of the prior art, and provides a foldable rack, which is beneficial to improving stability of the foldable rack.

The purpose of the present disclosure is achieved by the following technical solutions.

The foldable rack disclosed by the present disclosure includes pillars, a supporting rod and at least two groups of foldable plates, each of the foldable plates includes a first layer plate and a second layer plate, a first connecting piece is fixedly connected to a left end of the first layer plate, a right end of the first layer plate is pivotally connected with corresponding pillars, a second connecting piece is fixedly connected to a right end of the second layer plate, a left end of the second layer plate is pivotally connected with corresponding pillars; the supporting rod is connected with the first connecting piece and the second connecting piece through a pin shaft; the foldable rack further includes a lock catch assembly, the lock catch assembly comprises a slider, a driving arm, an upper lock catch, and a lock hook piece; the slider is matched and sleeved on the supporting rod, a left end and a right end of the slider are respectively pivotally connected with one of slider supporting rods; one end of each slider supporting rod distal from the slider is pivotally connected with a corresponding pillar, one end of the driving arm is pivotally connected with the slider, a lower end portion of the upper lock catch is pivotally connected with the driving arm, and an upper end portion of the upper lock catch is buckled with the lock hook piece; and the lock hook piece is separated from the supporting rod and is disposed on the first connecting piece or the second connecting piece.

Optional, the lock hook piece is integrated with the first connecting piece or the second connecting piece.

Optional, the foldable rack includes a top plate, a right end of the top plate is pivotally connected with corresponding pillars; a bearing rod is fixedly connected to the pillars, a left end of the top plate is disposed on the bearing rod, and at least one of buckling blocks is fixedly connected to the left end of the top plate; at least one of convex blocks is fixedly connected to a corresponding pillar, and each of the buckling blocks is buckled with a corresponding convex block.

Optional, the buckling blocks are disposed on both a front end and a rear end of the top plate.

Optional, a cross section of the supporting rod and a cross section of the slider supporting rod are in rectangular shapes.

Optional, the lock catch assembly, the lock catch assembly, the supporting rod, and the slider supporting rod are disposed between rear side surfaces of the pillars in a rear and rear end surfaces of the foldable plates.

Optional, fences are respectively disposed on a left side and a right side of each of the foldable plates, each of the fences includes two cross rods and a plurality of vertical rods, the vertical rods are disposed between the two cross rods, a front end and a rear end of the cross rods are respectively fixedly connected with corresponding pillars.

Optional, lower ends of the pillars are provided with casters.

Compared with the prior art, the present disclosure has the following beneficial effects: the lock hook piece is separated from the supporting rod, and the lock hook piece is disposed on the first connecting piece or the second connecting piece, so that the pin shaft used for connecting the first connecting piece and the second connecting piece is prevented from being locked due to a complicated connection position with the supporting rod, when accidental stress forces the foldable plates to fold, the supporting rod is prevented from being bent by the upper lock catch, so that stability of the foldable rack is improved, and in actual use, the foldable plates are kept in a flattened state stably.

1. pillar; 101. convex block; 102. bearing rod; 11. caster; 2. supporting rod;

3. foldable plate; 31. first layer plate; 32. second layer plate;

33. first connecting piece; 3301. flat plate portion; 3302. vertical plate portion;

34. second connecting piece; 4. lock catch assembly; 41. slider;

411. connecting plate part; 412. lug portion; 42. driving arm;

43. upper lock catch; 44. lock hook piece; 5. slider supporting rod; 6. top plate;

601. connecting piece; 602. buckling block; 7. fence; 701. cross rod;

702. vertical rod; 99. wall

DETAILED DESCRIPTION

The present disclosure is further described below in combination with the accompanying drawings.

Figure 1:
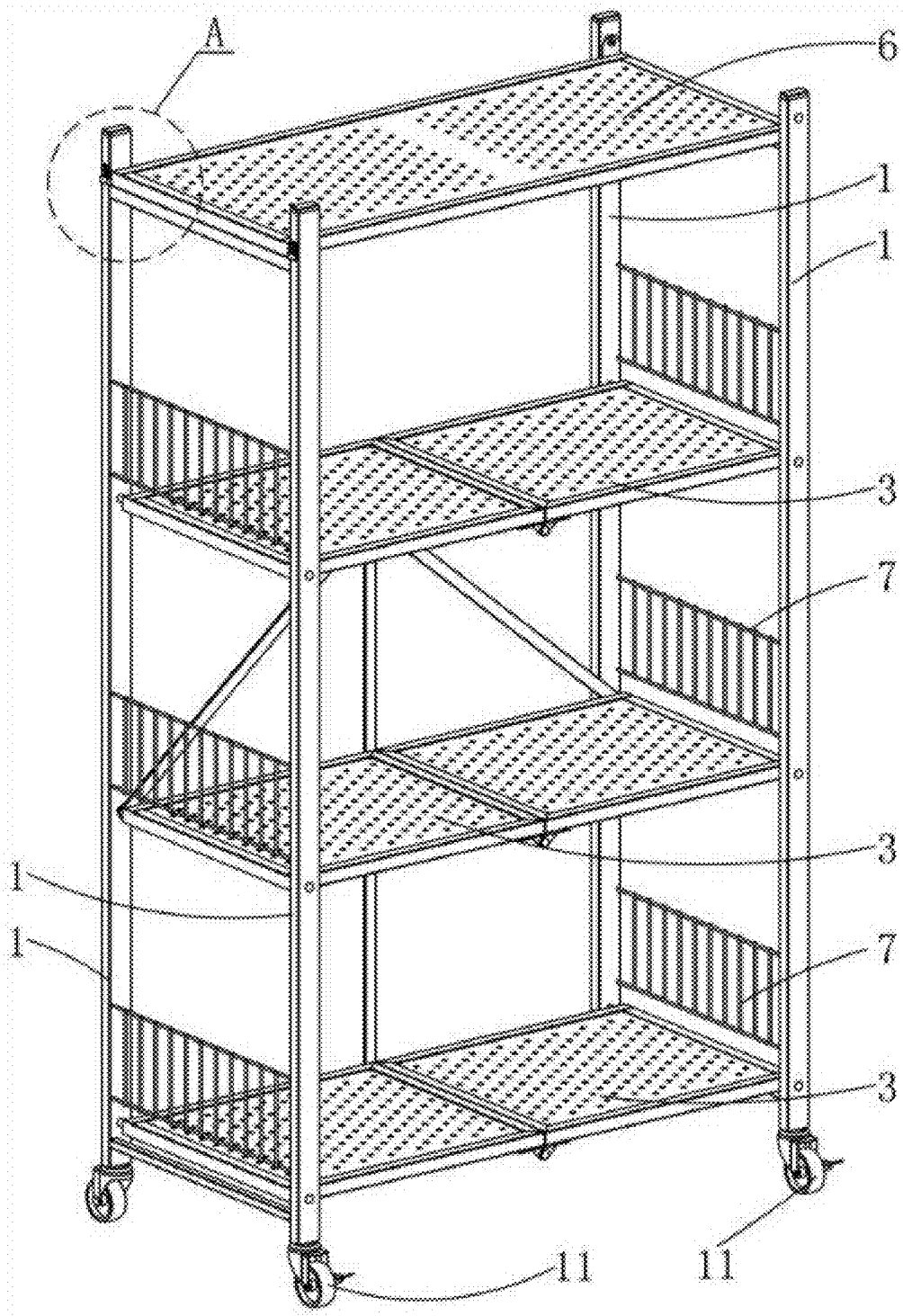
FIG. 1 is a schematic diagram of a three-dimensional structure of a front view direction of a foldable rack of the present disclosure.

Please note that the following description of orientation is based on the visual direction of FIG. 1.

Figure 2:
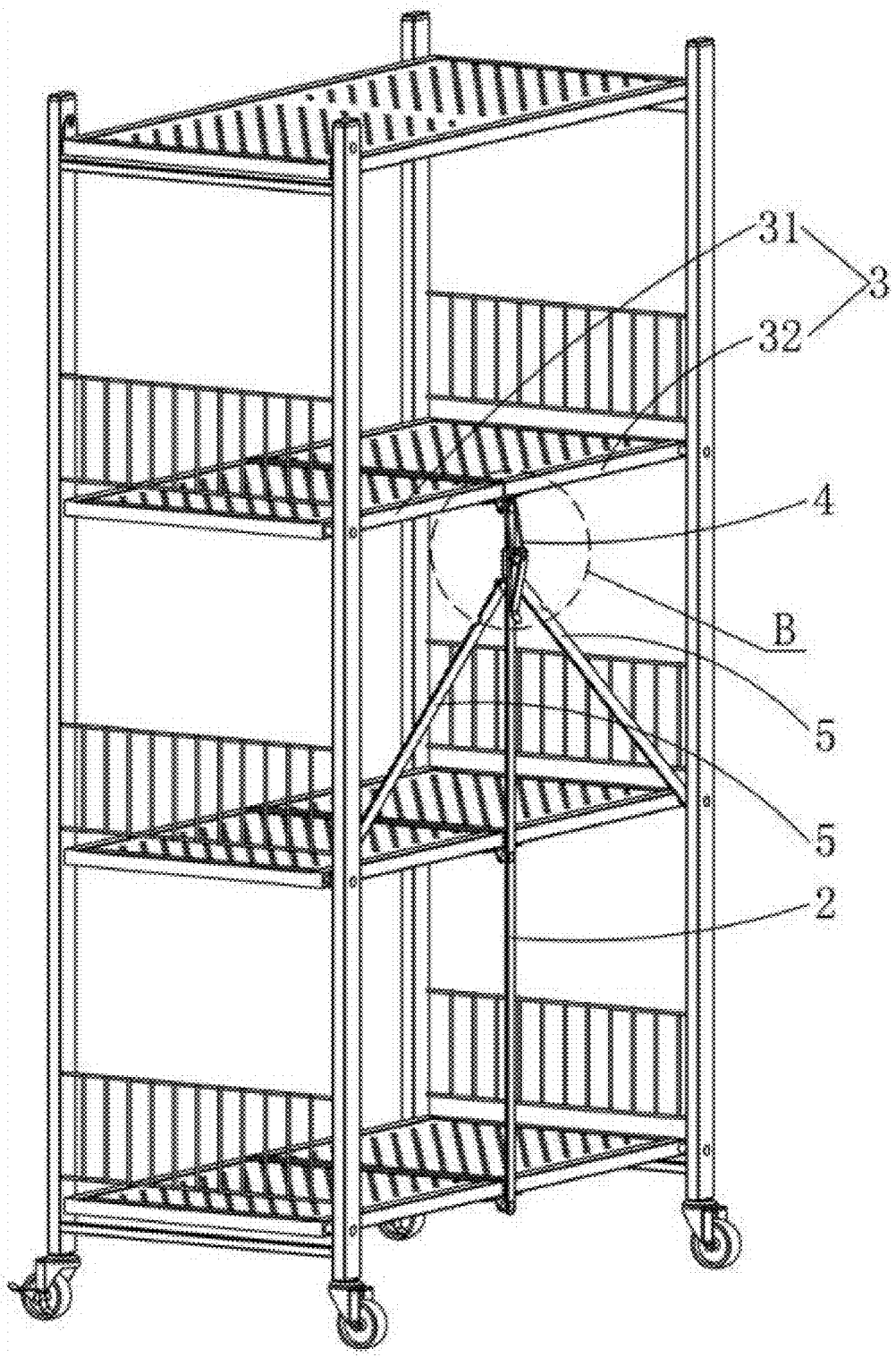
FIG. 2 is a schematic diagram of a three-dimensional structure of a rear view direction of a foldable rack of the present disclosure.
Figure 3:
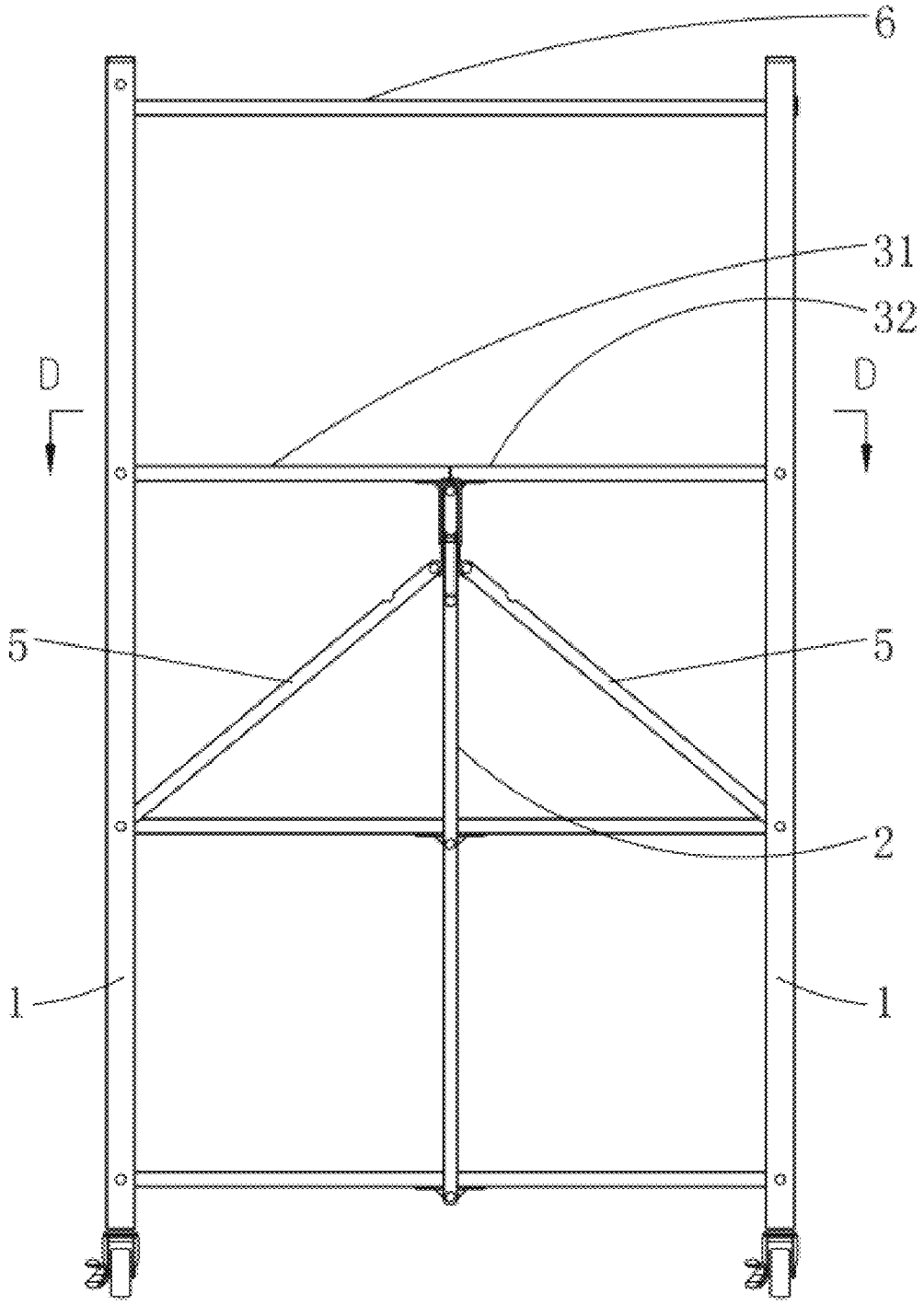
FIG. 3 is a schematic structural diagram of a rear view direction of a foldable rack of the present disclosure.
Figure 4:
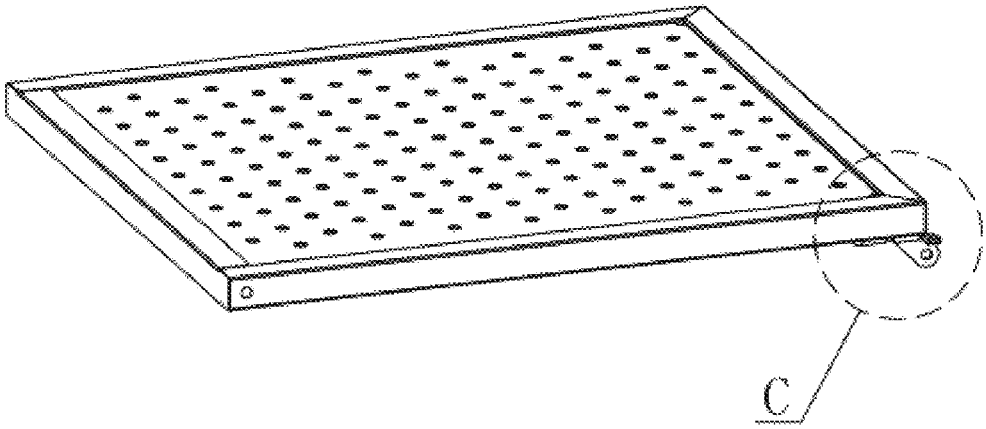
FIG. 4 is a schematic diagram of a three-dimensional structure of a rear view direction of a first layer plate of the present disclosure.
Figure 5:
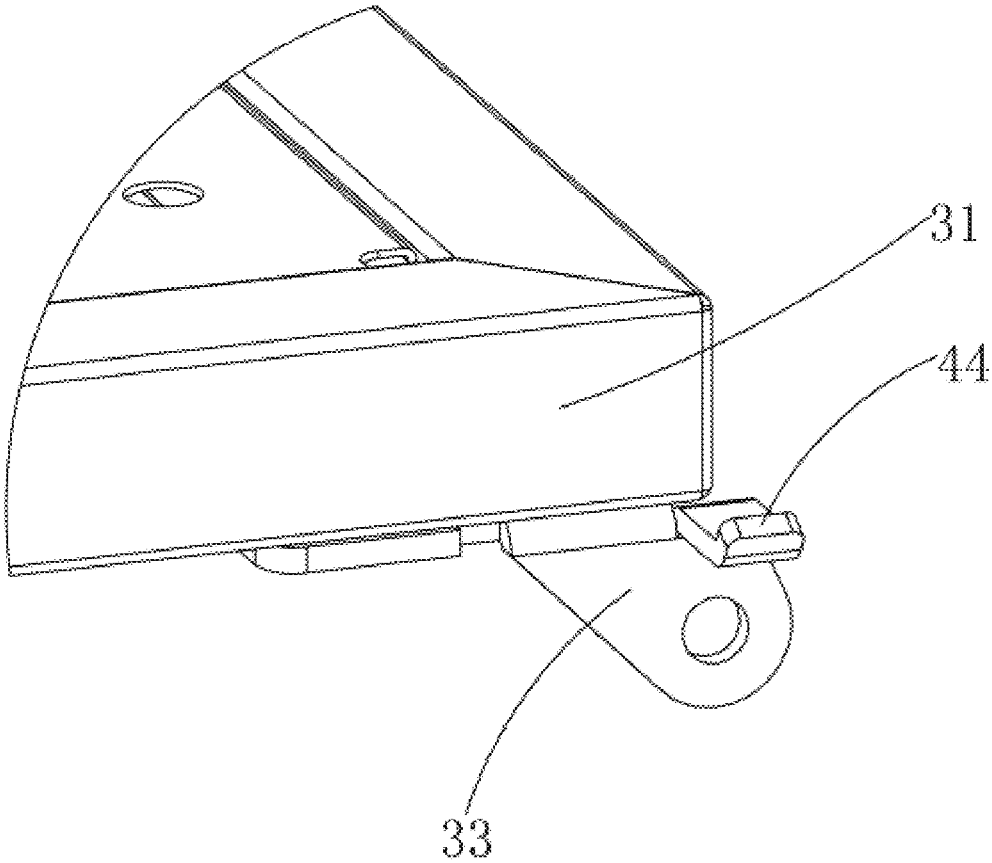
FIG. 5 is an enlarged view of portion C shown in FIG. 4.
Figure 6:
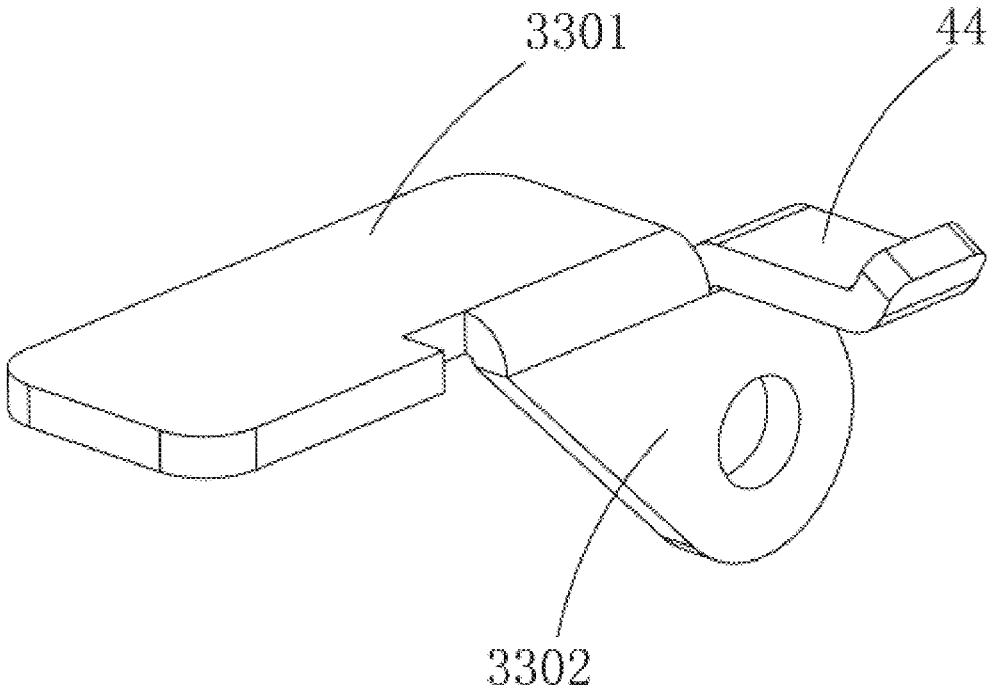
FIG. 6 is a schematic diagram of a three-dimensional structure of a rear view direction of a first connecting piece of the present disclosure.
Figure 7:
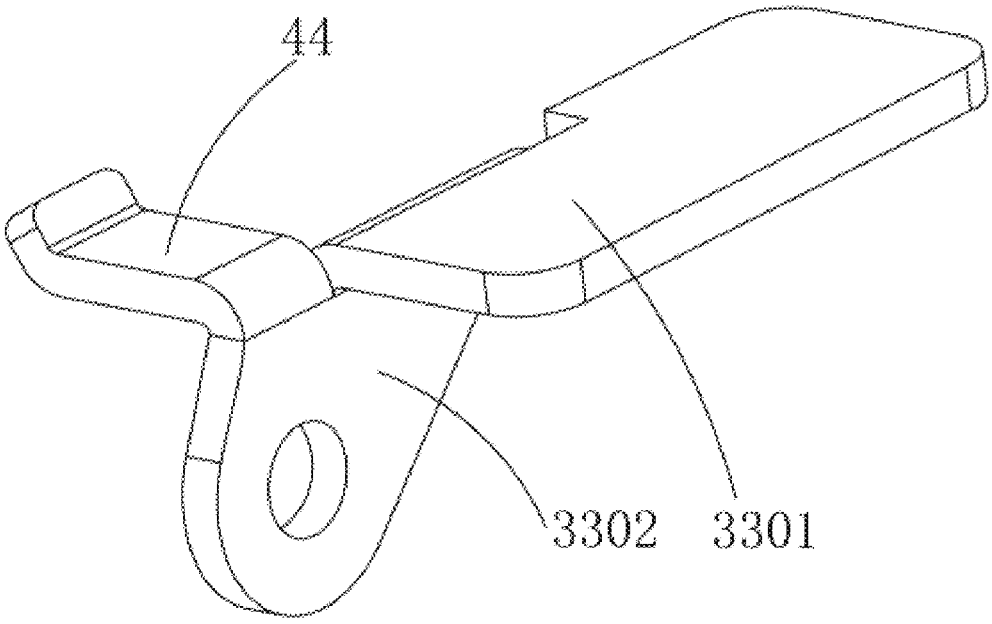
FIG. 7 is a schematic diagram of a three-dimensional structure of a front view direction of a first connecting piece of the present disclosure.
Figure 8:
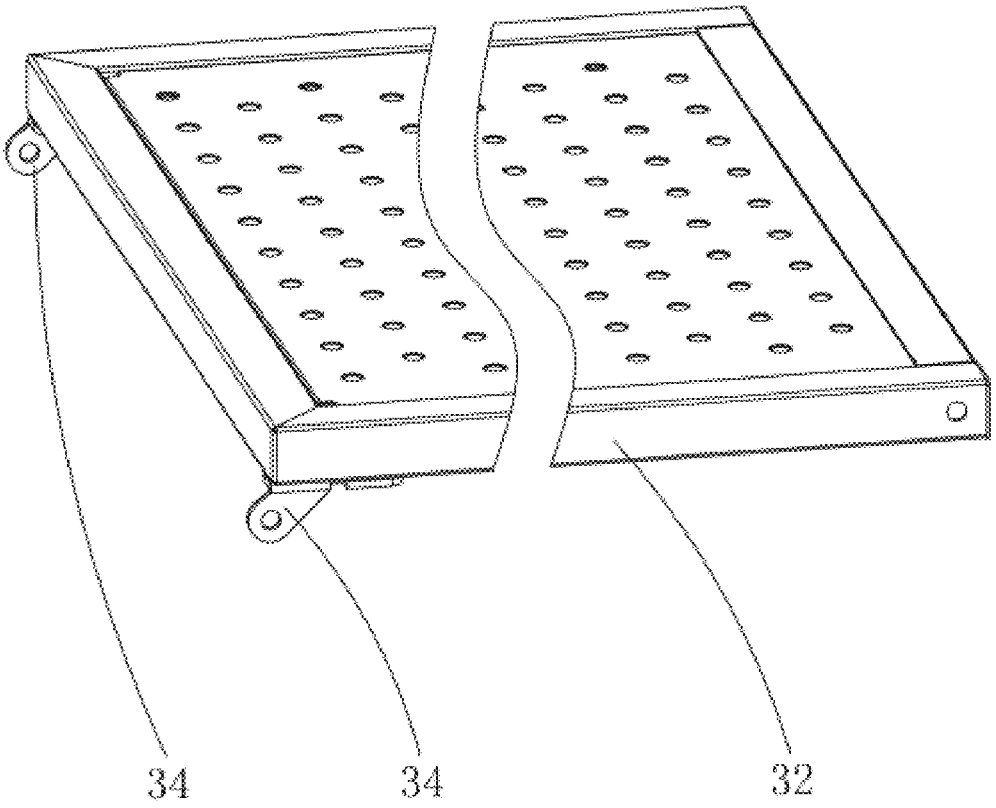
FIG. 8 is a schematic diagram of a three-dimensional structure of a rear view direction of a second connecting piece of the present disclosure.
Figure 9:
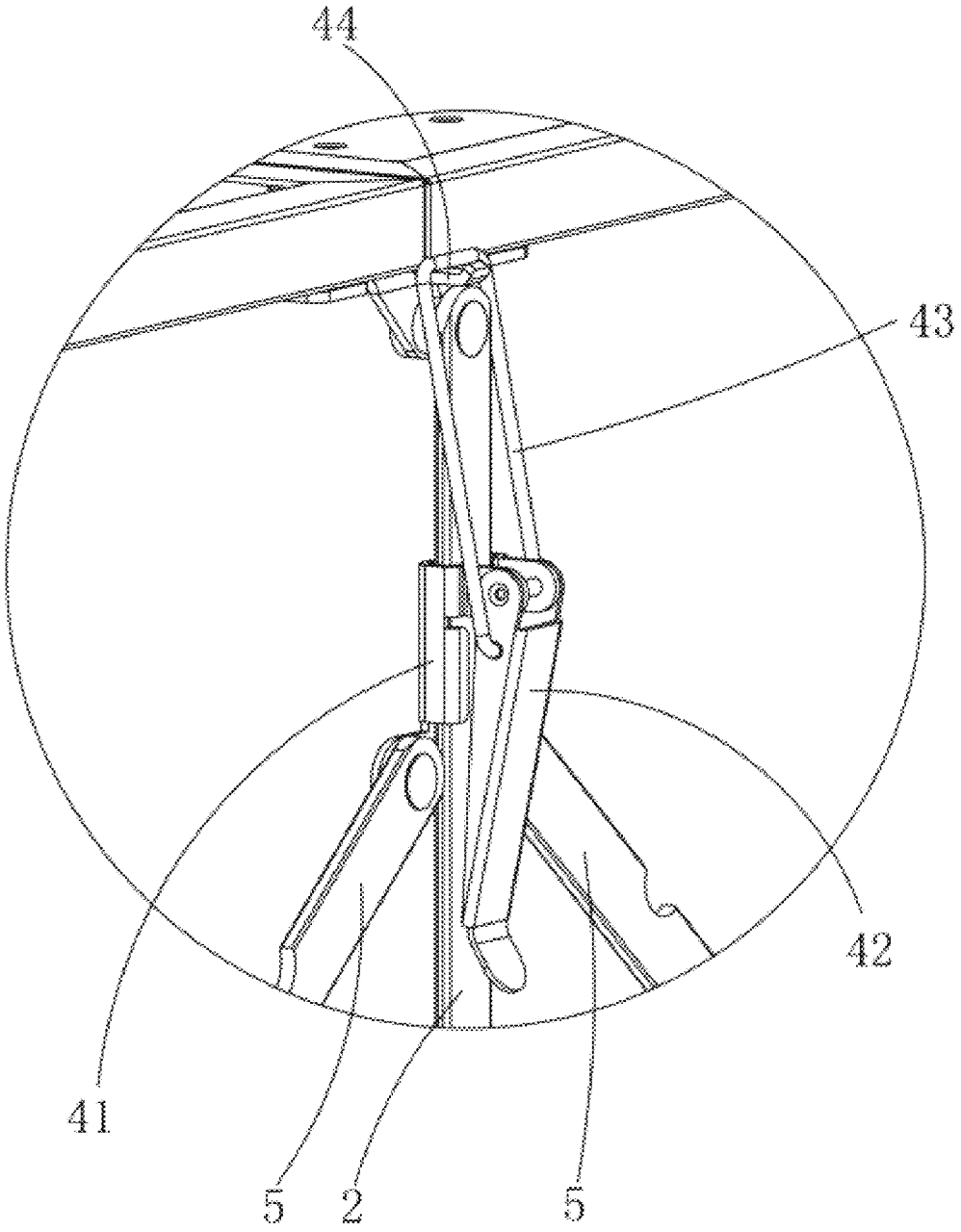
FIG. 9 is an enlarged view of portion B shown in FIG. 2.
Figure 10:
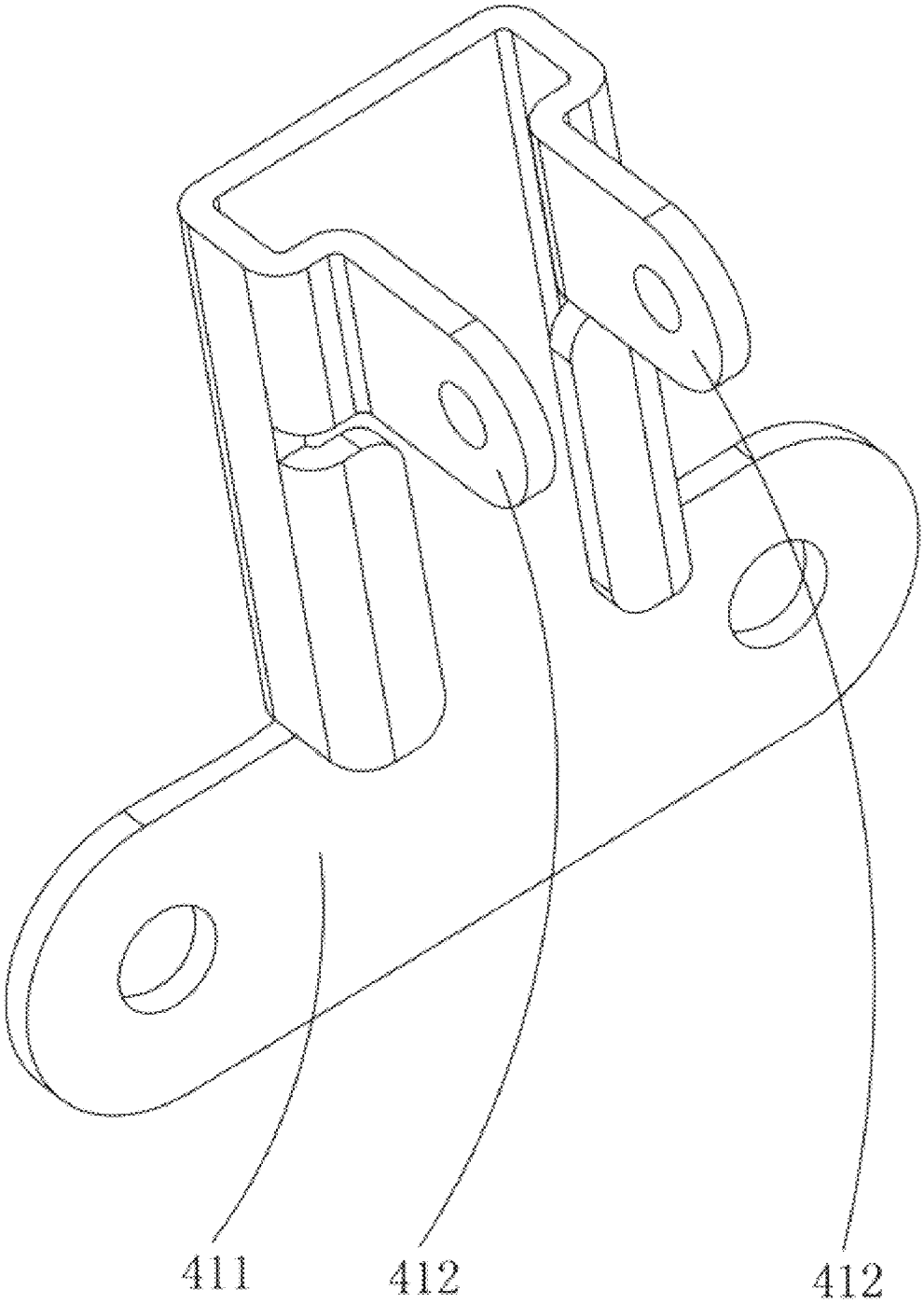
FIG. 10 is a schematic diagram of a three-dimensional structure of a slider of the present disclosure.
Figure 12:
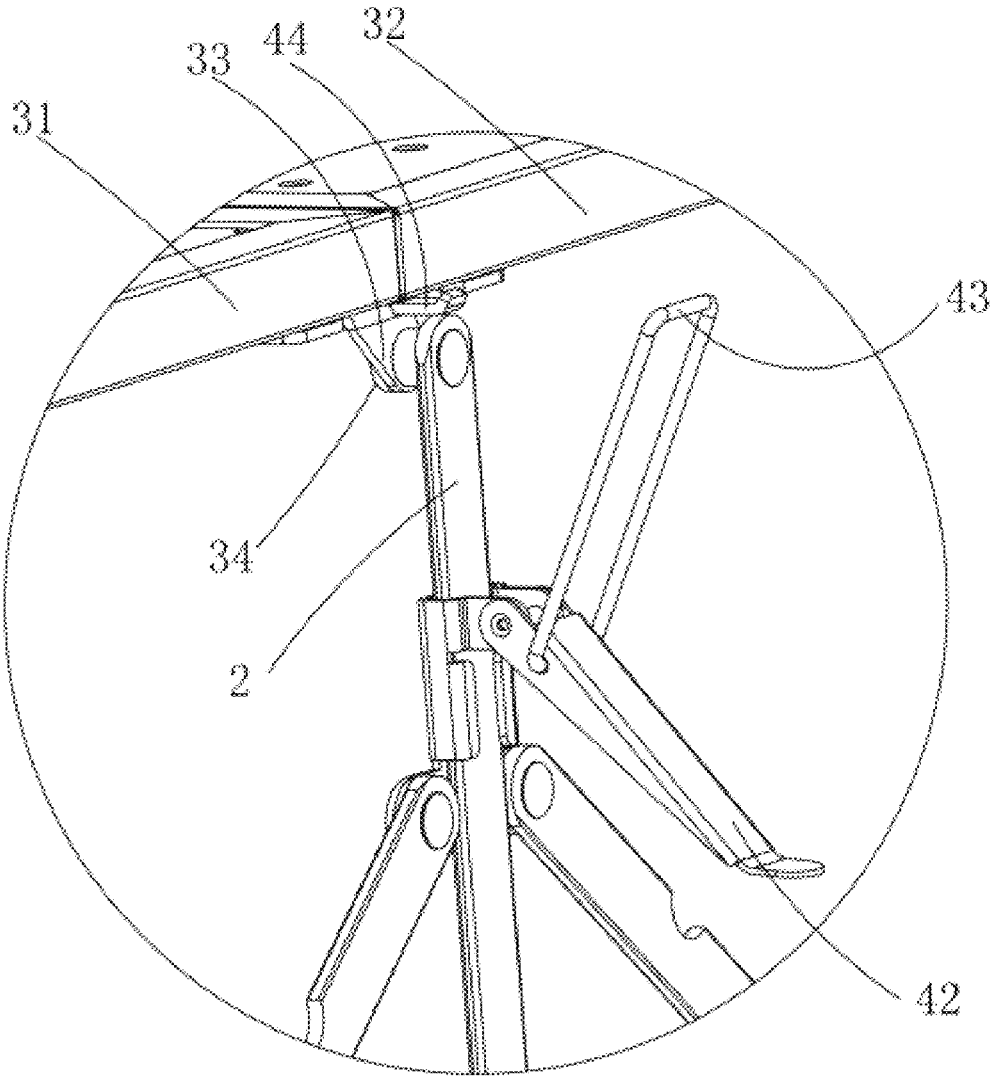
FIG. 12 is a schematic diagram of an outward swing state of an upper lock catch according to the FIG. 9 of the present disclosure.

As shown in FIG. 1, the foldable rack of the present disclosure includes pillars 1, a supporting rod 2 and at least two groups of foldable plates 3. A number of pillars is four, and a number of foldable plates in FIG. 1 is three. As shown in FIG. 2, the foldable plate 3 includes a first layer plate 31 and a second layer plate 32, as shown in FIG. 4 and FIG. 5, a first connecting piece 33 is fixedly connected to a left end of the first layer plate 31, a right end of the first layer plate 31 is pivotally connected with corresponding pillars 1, as shown in FIG. 8, a second connecting piece 34 is fixedly connected to a right end of the second layer plate 32, a left end of the second layer plate 32 is pivotally connected with corresponding pillars 1, as shown in FIG. 2 and FIG. 12, the supporting rod 2 is connected with the first connecting piece 33 and the second connecting piece 34 through a pin shaft, the pin shaft is located on a lower side of a corresponding foldable plate 3, the first layer plate 31 and the second layer plate 32 of a group of foldable plates 3 are connected through the pin shaft, the supporting rod 2 is simultaneously connected with the pin shaft of each group of foldable plates 3, the first layer plate 31 and the second layer plate 32 abut against each other in a flattened state, as shown in FIG. 2 and FIG. 9, the foldable rack further includes a lock catch assembly 4, the lock catch assembly 4 includes a slider 41, a driving arm 42, an upper lock catch 43 and a lock hook piece 44, the slider 41 is matched and sleeved on the supporting rod 2, as shown in FIG. 10, the slider 41 is made of steel plate through a bending process, a lower portion of the slider 41 is set as a connecting plate part 411, a left end and a right end of the connecting plate part 411 respectively define a through hole, a left end and a right end of the slider 41 are respectively pivotally connected with a slider supporting rod 5, specifically, a pin simultaneously penetrate through a end of a corresponding slider supporting rod 5 and the through hole of a corresponding connecting plate part 411, as shown in FIG. 2, one end of each slider supporting rod 5 distal from the slider 41 is pivotally connected with a corresponding pillar 1, in other words, one end of each slider supporting rod 5 is pivotally connected with a corresponding pillar 1, and the other end of each slider supporting rod 5 is pivotally connected with the slider 41, more specifically, the slider supporting rods 5 and the second group of the foldable plates 3 counting from top to bottom in FIG. 3 share rotating shafts connected to the pillars 1. As shown in FIG. 9, an end of the driving arm 42 is pivotally connected with the slider 41, as shown in FIG. 10, an upper portion of the slider 41 includes a lug portion 412, an end of the driving arm 42 is specifically pivotally connected with the lug portion 412, and a lower end portion of the upper lock catch 43 is pivotally connected with the driving arm 42, specifically, the upper lock catch 43 is formed by bending a steel rod to be in a rectangular ring shape, and the lower end portion of the upper lock catch 43 is matched and inserted into the driving arm 42, so that the upper lock catch 43 swings around its own lower end portion, an upper end portion of the upper lock catch 43 is buckled with the lock hook piece 44.

The lock hook piece 44 of the present disclosure is separated from the supporting rod 2, and the lock hook piece 44 is disposed on the first connecting piece 33 or the second connecting piece 34, in the present embodiment, referring to FIGS. 4-7, an embodiment in which the lock hook piece 44 is fixedly connected to the first connecting piece 33 is shown, the first connecting piece 33 and the second connecting piece 34 are symmetrical structure, and the symmetrical structure described herein does not include the lock hook piece 44. The first connecting piece 33 includes a flat plate portion 3301 for welding with a lower side surface of the first layer plate and a vertical plate portion 3302 for pivoting with the second connecting piece 34, the lock hook piece 44 is fixed to an upper end of the vertical plate portion 3302. In addition, since the second connecting piece 34 is only a symmetrical structure of the first connecting piece 33, an embodiment in which the lock hook piece 44 is integrated with the second connecting piece 34 is not shown in a drawing, during manufacturing, it is only to symmetrically transfer the lock hook piece 44 fixedly connected to the first connecting piece 33 as shown in FIGS. 4-7 to the second connecting piece 34.

As shown in FIG. 1, lower ends of the pillars 1 are provided with casters 11, the casters 11 are products commercially available on the market; by setting the casters 11, the foldable rack of the present disclosure is conveniently to move, two casters 11 located on a front side in FIG. 1 are casters with locks, the casters with locks are also products commercially available on the market; after the foldable rack is moved, the two casters with locks are locked, so that the foldable rack is fixed.

Figure 11:
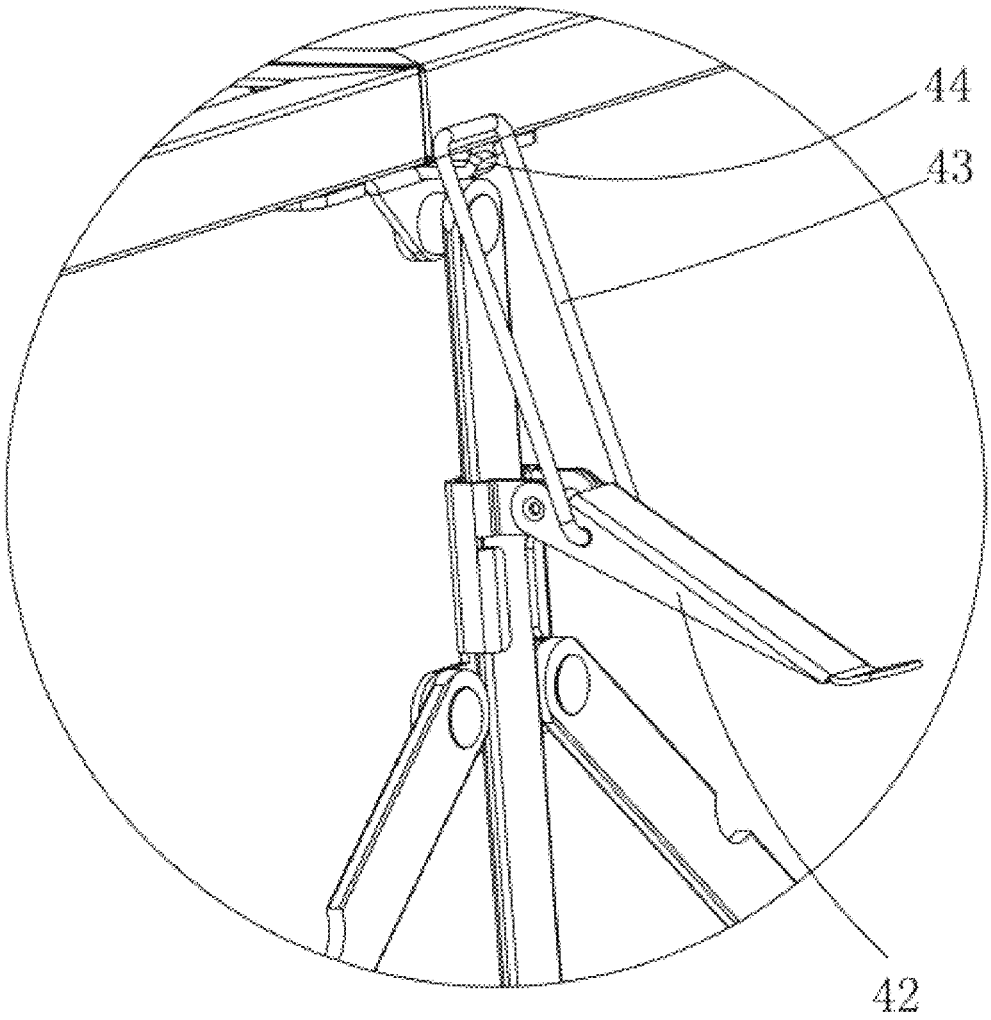
FIG. 11 is a schematic diagram of an upward swing state of a driving arm according to the FIG. 9 of present disclosure.
Figure 16:
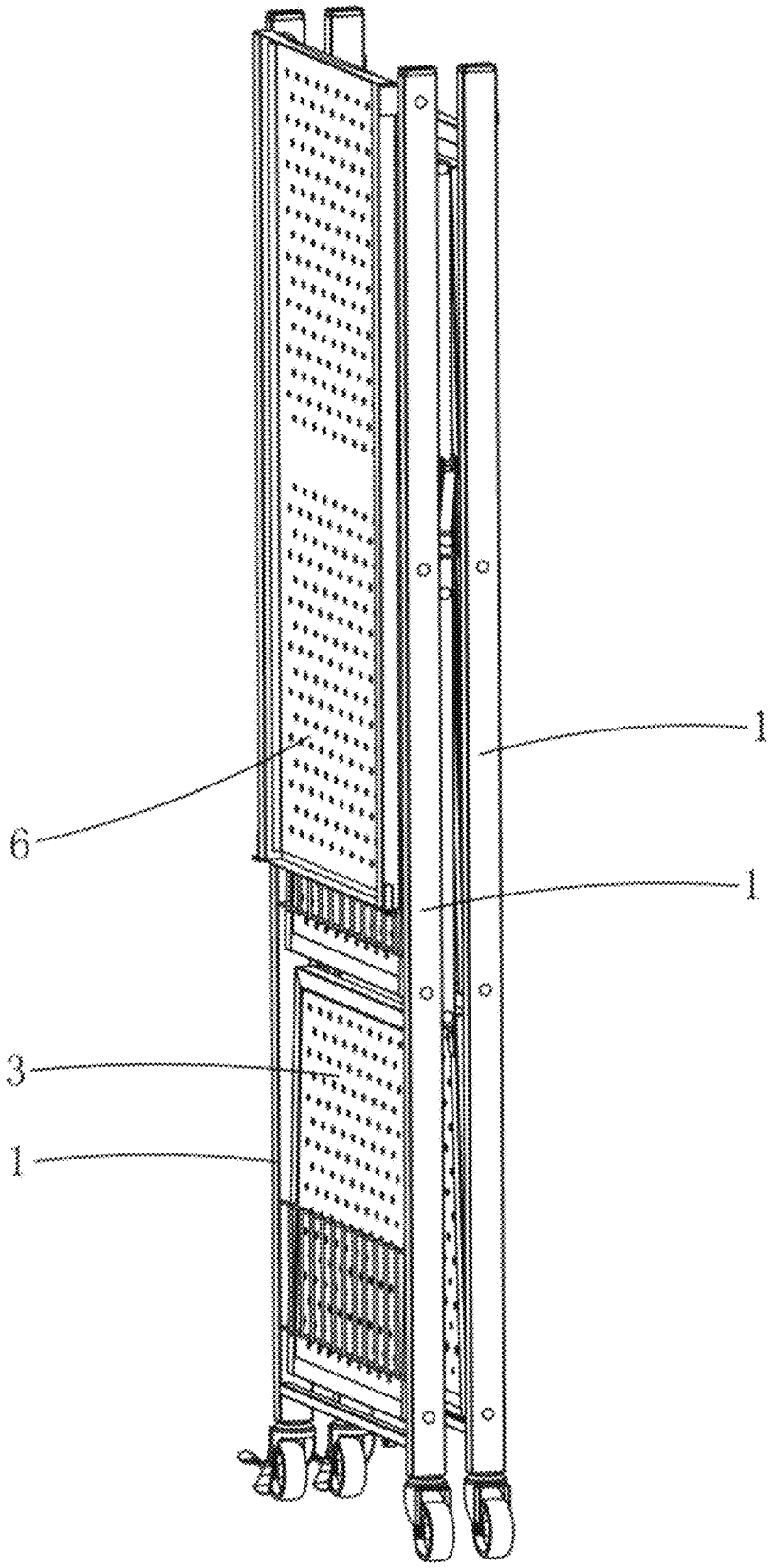
FIG. 16 is a schematic diagram of a folding state of a rear view direction of a foldable rack of the present disclosure.

The following is a brief description of folding principle of the folding layer frame of the present disclosure: swing the driving arm 42 upward to a position shown in FIG. 11 by hand, since the lower end portion of the upper lock catch 43 also moves upward during swing process of the driving arm 42, the upper end portion of the upper lock catch 43 moves away from the locking hook piece 44, then swing the upper lock catch 43 outward by hand to the position shown in FIG. 12, so that the upper lock catch 43 is completely separated from the lock hook piece 44, then hold up a middle portion of the foldable plate 3 by hand, so that the middle portion of the foldable plate 3 rises upward, that is, the first layer plate 31 and the second layer plate 32 are folded, since the supporting rod 2 is connected with the first connecting piece 33 and the second connecting piece 34 by the pin shaft, the supporting rod 2 also moves upward, that is, the supporting rod 2 moves upward relative to the slider 41, the foldable rack of present disclosure is finally folded into a state shown in FIG. 16, which is convenient for mailing and transportation. Conversely, when the users unfold the foldable shelf to use, pull the pillars 1 on a left side and a right side by hand to unfold the foldable plate 3, then hang upper lock catch 43 on the lock hook piece 44, and then swing the driving arm 42 downward, and the driving arm 42 drives the lower end portion of the upper lock buckle 43 to move downward, so the upper end portion of the upper lock catch 43 is fastened to the lock hook piece 44 again, in a state (the state shown in FIG. 9), when the middle portion of the foldable plate 3 is lifted by hand again to try to fold the foldable plate 3, the first connecting piece 33 tends to move upward away from the slider 41, since the upper lock buckle 43 is hung on the lock hook piece 44, the first connecting piece 33 is inactive. Since the lock hook piece 44 is fixedly connected to the first connecting piece 33, when accidental stress forces the foldable plates 3 to be folded, it prevents the supporting rod 2 from being bent by the upper lock catch 43, so that stability of the foldable rack is improved, and in actual use, the foldable plates 3 are kept in a flattened state stably.

Further, FIGS. 4-7 show an embodiment in which the lock hook piece 44 is integrally with the first connecting piece 33, the first connecting piece 33 and the lock hook piece 44 are made of a same steel plate through a bending process, compared with the structure in which the lock hook piece 44 is welded to the first connecting piece 33, the integrated arrangement of the locking hook piece 44 and the first connecting piece 33 is beneficial to increase strength of the locking hook piece 44, and is easy to manufacture.

Figure 13:
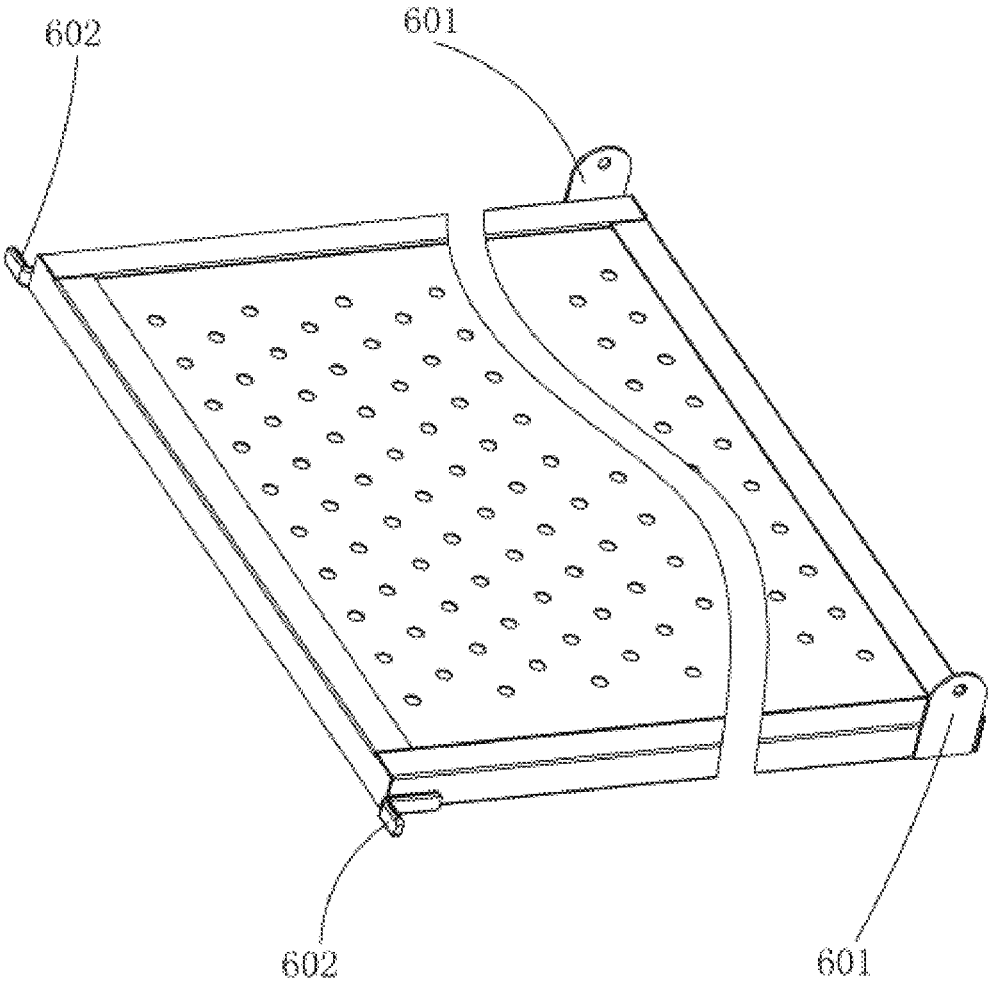
FIG. 13 is a schematic diagram of a three-dimensional structure of a front view direction of a top plate of the present disclosure.
Figure 14:
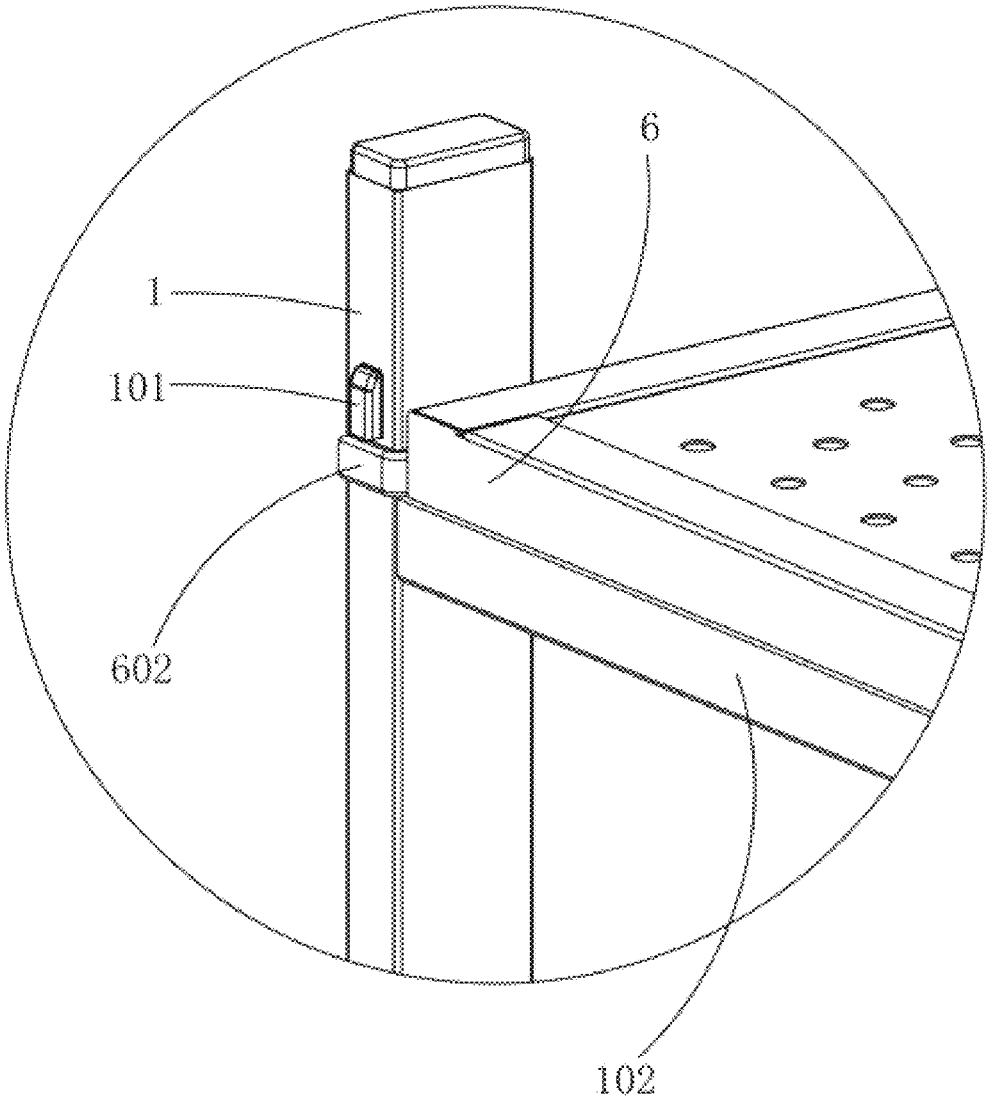
FIG. 14 is an enlarged view of portion A in FIG. 1.

Further, as shown in FIG. 1, the foldable rack includes a top plate 6, a right end of the top panel 6 is pivotally connected with the corresponding pillars 1, that is, the right end of the top plate 6 is pivotally connected with a right side pillars 1 in FIG. 1, specifically, as shown in FIG. 13, a right end of the top plate 6 is welded with two connecting pieces 601, and two connecting pieces 601 are respectively pivotally connected with the corresponding two pillars located on the right side, as shown in FIG. 14, a bearing rod 102 is fixedly connected to the pillars 1, the bearing rod 102 is arranged in the front-back direction, a left end of the top plate 6 is disposed on the bearing rod 102, that is, the bearing rod 102 is welded between two left side pillars 1, as shown in FIG. 13 at least one of buckling blocks 602 is fixedly connected to the left end of the top plate 6, as shown in FIG. 14, at least one of convex blocks 101 is fixedly connected to a corresponding pillar 1, and each of the buckling blocks 602 is buckled with a corresponding convex block 101, an upper end portion of each of the convex blocks 101 is formed with an inclined surface, so that a corresponding buckling block 602 is convenient to buckle. As shown in FIG. 16, the top plate 6 may be turned over and folded during transportation, before use, user turns the top plate 6 over the foldable plates 3, then presses down an end of the top plate 6 with the at least one of buckling blocks 602 firmly, and buckle each of the buckling blocks 602 into a corresponding convex block 101, so that the top plate 6 is fixed, an installation process of the at least one of buckling blocks 602 and the the at least one of convex blocks 101 is simple and convenient, since a left end and a right end of the top plate 6 are supported by the pillars 1, heavier items may be placed on the top plate 6.

Further, as shown in FIG. 13, the buckling blocks 602 are disposed on both a front end and a rear end of the top plate 6, that is, a number of convex blocks 101 is correspondingly two, and two convex blocks 101 are respectively welded to two pillars 1 located on a left side, this arrangement is conducive to reliable fixation of the top plate 6, and prevents the top plate 6 from being twisted away from the convex blocks 101 when the top plate 6 is accidentally lifted up.

Further, as shown in FIG. 9, a cross section of the supporting rod 2 and a cross section of the slider supporting rod 5 are in rectangular shapes, that is, the supporting rod 2 and the slider supporting rod 5 are made of solid flat steel, the solid flat steel is a common material, while the supporting rod 2 and the slider supporting rod 5 in the prior art are made of rectangular tubes, that is, a cross section of the supporting rod 2 and a cross section of the slider supporting rod 5 of the prior art are in rectangular ring shapes, under same cross-sectional shape and size, the supporting rod 2 and the slider supporting rod 5 of the present embodiment have high strength, in order to achieve sufficient strength, the supporting rod 2 and the slider supporting rod 5 of the prior art have a relatively large cross-sectional shape, which results in a large space occupation, the supporting rod 2 and the slider supporting rod 5 of the present embodiment are beneficial to compact structure of the foldable rack, and are beneficial to vacate more storage space.

Figure 15:
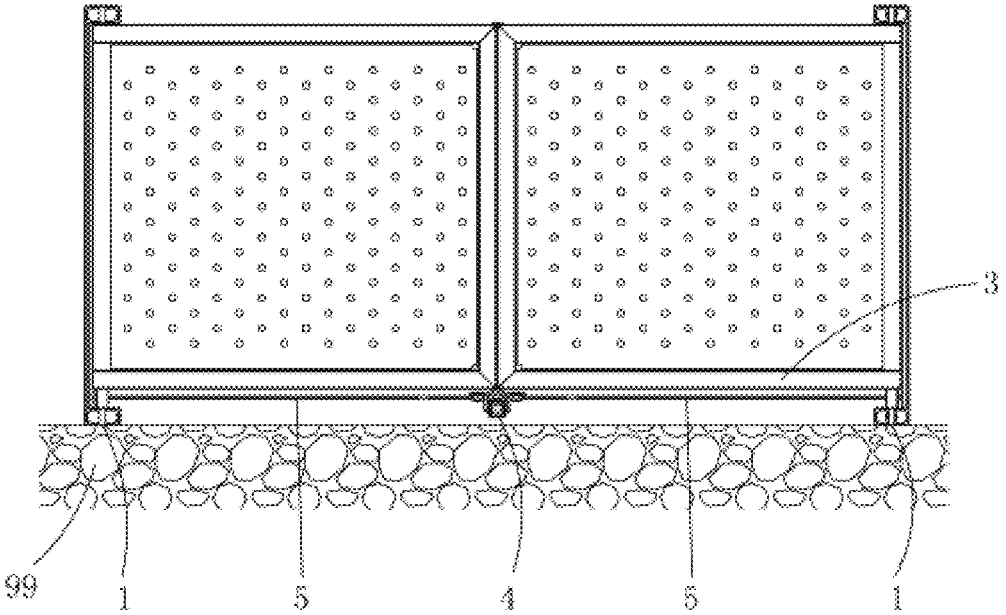
FIG. 15 is a cross-sectional view taken along line D-D shown in FIG. 3.

Further, as shown in FIG. 2 and FIG. 15 (note that FIG. 15 does not show the casters 11 for ease of viewing), the lock catch assembly 4, the supporting rod 2 and the slider supporting rod 5 are disposed between rear side surfaces of the pillars 1 in a rear and rear end surfaces of the foldable plates 3, this arrangement prevents the lock catch assembly 4 from protruding backward beyond pillars 1 in a rear, thus, it is avoided that the lock catch assembly 4 interferes with home facilities behind the foldable rack when the home facilities are placed, and it is convenient for the foldable rack of the present embodiment to be placed against the wall 99 to the maximum, the foldable rack is equipped with small casters or casters which are retracted/inward swing at bottom of the foldable rack, the foldable rack may be completely placed against the wall, as shown in FIG. 15.

Figure 17:
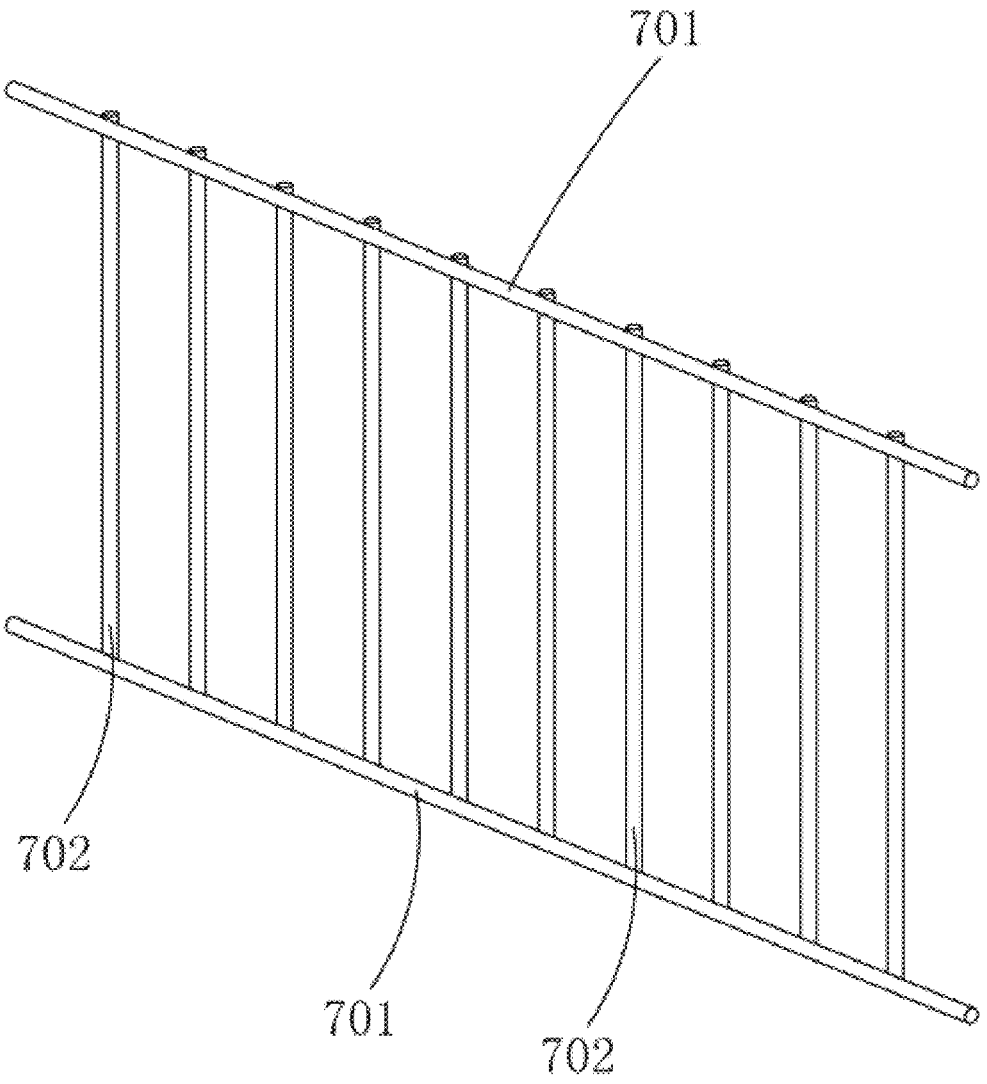
FIG. 17 is a schematic diagram of a three-dimensional structure of a fence of the present disclosure.

Further, as shown in FIG. 1, fences 7 are respectively disposed on a left side and a right side of each of the foldable plates 3, as shown in FIG. 17, each of the fences 7 includes two cross rods 701 and a plurality of vertical rods 702, the vertical rods 702 are disposed between the two cross rods 701, the vertical rods 702 are welded with the two cross rods 701 to form a parallel-spaced wire protection net structure, as shown in FIG. 1, a front end and a rear end of the cross rods are respectively fixedly connected with corresponding pillars 1, which is beneficial to make the fences 7 firm. By arranging the fences 7, items placed on the foldable plates 3 are prevented from falling accidentally from a left side and a right side of the foldable plates, a structure of each of the fences 7 is simple, and the fences 7 are easy to manufacture.

What is claimed is:

1. A foldable rack, comprising:

pillars;

a supporting rod;

at least two groups of foldable plates; and a lock catch assembly;

wherein each of the foldable plates comprises a first layer plate and a second layer plate; a first connecting piece is fixedly connected to a left end of the first layer plate, a right end of the first layer plate is pivotally connected with corresponding pillars, a second connecting piece is fixedly connected to a right end of the second layer plate, a left end of the second layer plate is pivotally connected with corresponding pillars; the supporting rod is connected with the first connecting piece and the second connecting piece through a pin shaft; the lock catch assembly comprises a slider, a driving arm, an upper lock catch, and a lock hook piece; the slider is matched and sleeved on the supporting rod, a left end and a right end of the slider are respectively pivotally connected with one of slider supporting rods; one end of each slider supporting rod distal from the slider is pivotally connected with a corresponding pillar, one end of the driving arm is pivotally connected with the slider, a lower end portion of the upper lock catch is pivotally connected with the driving arm, and an upper end portion of the upper lock catch is buckled with the lock hook piece; and the lock hook piece is separated from the supporting rod and is disposed on the first connecting piece or the second connecting piece.

2. The foldable rack according to claim 1, wherein the lock hook piece is integrated with the first connecting piece or the second connecting piece.

3. The foldable rack according to claim 1, further comprising a top plate; wherein a right end of the top plate is pivotally connected with corresponding pillars; a bearing rod is fixedly connected to the pillars, a left end of the top plate is disposed on the bearing rod, and at least one of buckling blocks is fixedly connected to the left end of the top plate; at least one of convex blocks is fixedly connected to a corresponding pillar, and each of the buckling blocks is buckled with a corresponding convex block.

4. The foldable rack according to claim 3, wherein the buckling blocks are disposed on both a front end and a rear end of the top plate.

5. The foldable rack according to claim 1, wherein a cross section of the supporting rod and a cross section of the slider supporting rod are in rectangular shapes.

6. The foldable rack according to claim 5, wherein the lock catch assembly, the supporting rod, and the slider supporting rod are disposed between rear side surfaces of the pillars in a rear and rear end surfaces of the foldable plates.

7. The foldable rack according to claim 1, wherein fences are respectively disposed on a left side and a right side of each of the foldable plates, each of the fences comprises two cross rods and a plurality of vertical rods, the vertical rods are disposed between the two cross rods, a front end and a rear end of the cross rods are respectively fixedly connected with corresponding pillars.

8. The foldable rack according to claim 1, wherein lower ends of the pillars are provided with casters.

* * * * *